United States Patent [19]

Sachs

[11] Patent Number: 4,461,521

[45] Date of Patent: Jul. 24, 1984

[54] STRAND HANGER BRACKET WITH COMMON GROUND CONNECTIONS

[76] Inventor: Isaac Sachs, 1240 Ridgewood Dr., Chomedey, Laval, Quebec, Canada, H7W 1L3

[21] Appl. No.: 375,391

[22] Filed: May 6, 1982

[51] Int. Cl.[3] ..... H01R 4/66

[52] U.S. Cl. ..... 339/14 R; 174/41; 174/44; 339/263 L; 339/271

[58] Field of Search ..... 339/263 L, 264 L, 265 F, 339/266 G, 266 L, 14; 174/41, 43, 44; 358/86, 305

[56] References Cited

U.S. PATENT DOCUMENTS

| | | | |
|---|---|---|---|
| 1,258,657 | 3/1918 | Cuthbert | 339/271 |
| 2,260,219 | 10/1941 | Gates | 339/269 |
| 3,423,724 | 1/1969 | Clement | 339/269 |
| 4,014,504 | 3/1977 | Sachs | 174/43 X |

FOREIGN PATENT DOCUMENTS

| | | | |
|---|---|---|---|
| 520145 | 4/1940 | United Kingdom | 339/263 L |
| 673907 | 6/1952 | United Kingdom | 339/269 |

*Primary Examiner*—Eugene F. Desmond

*Attorney, Agent, or Firm*—Swabey, Mitchell, Houle, Marcoux & Sher

[57] ABSTRACT

The invention is concerned with a bracket for hanging a multi-tap directional coupling device from a suspended wire, such as a strand running between poles on a street, and for grounding a plurality of support wires each of which extends along a respective cable, connected to the coupling device, for supporting same, the support wires each having a terminal end and a connecting portion contiguous thereto. The hanger bracket of the invention comprises an elongated member having a first end portion adapted to be detachably coupled to the coupling device, a second end portion provided with clamp means for releasable clamping engagement with the suspended wire, and a portion intermediate the first and second end portions defining a grounding plate. A separate fastener means is associated with each support wire for releasably securing the connecting portion thereof against the grounding plate whereby to provide a common ground for all the support wires. Preferably, the grounding plate is provided with a separate wire end retention means associated with each fastener means for retaining the terminal end of each support wire whereby to allow the connecting portion of each support wire to be bent about its associated fastener means while the terminal end thereof is retained captive by the associated wire end retention means, prior to the connecting portion being secured by its associated fastener means.

16 Claims, 4 Drawing Figures

Fig. 1
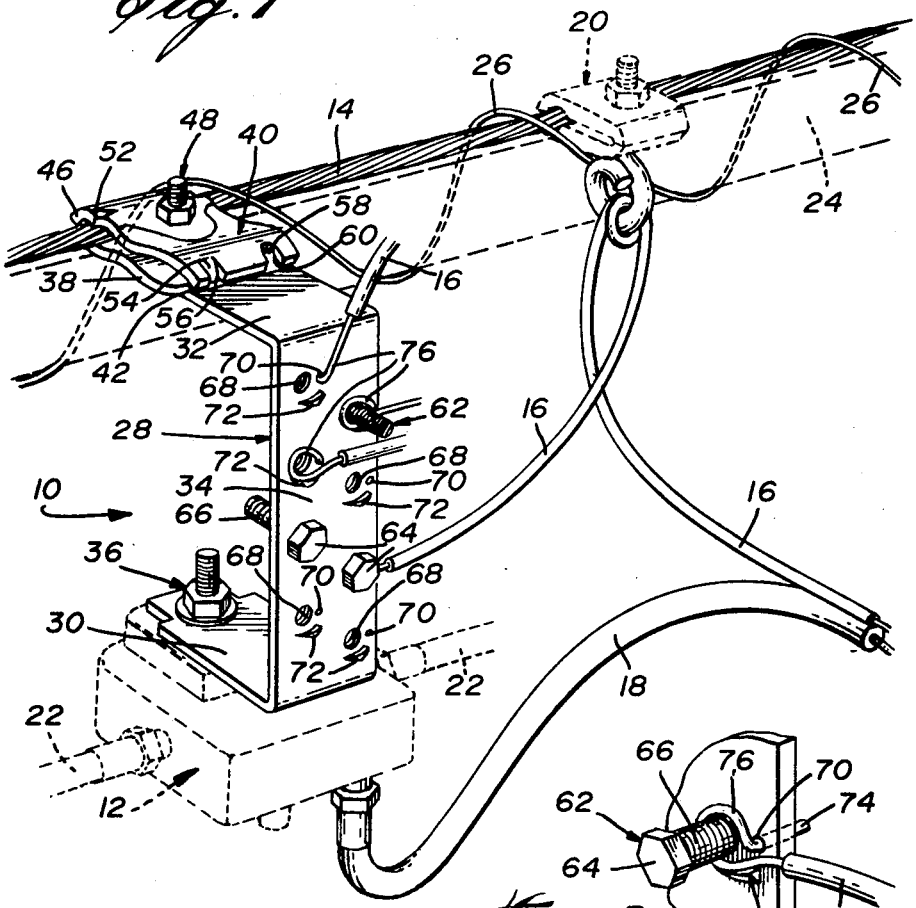
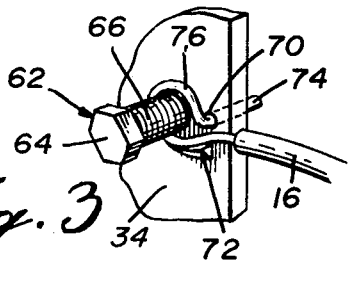
Fig. 3
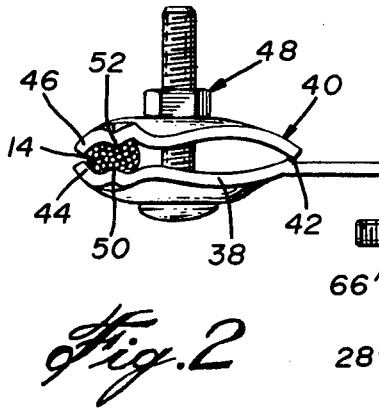
Fig. 2
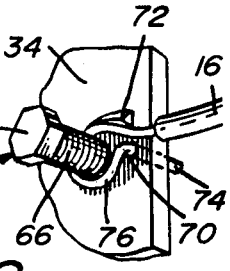
Fig. 3A

STRAND HANGER BRACKET WITH COMMON GROUND CONNECTIONS

BACKGROUND OF THE INVENTION

The present invention is directed towards improvements in hanger brackets. More particularly, the invention is concerned with an improved bracket for hanging a multi-tap directional coupler from a suspended wire, such as a strand running between poles on a street.

In the cable TV industry, when it is desired to bring a TV signal from a trunk cable which runs parallel with the strand to one or more nearby houses, a multi-tap directional coupler must be installed on the strand and connected by means of a feederline to the trunk cable, with one or more steel messenger coaxial cables connected to the taps of the coupler and extending therefrom to the houses. To this end, a generally L-shaped or U-shaped hanger bracket is used, one end of the bracket being secured to the coupler and the other end clamped onto the strand. The steel messenger wire which extends along each coaxial cable to support same is hooked to the strand by means of a suitable hooking member so as to hold the cable which is connected to the coupler. As each messenger wire must be grounded, it has been the practice to individually connect these messenger wires directly to the strand by means of individual clamping members. Thus, when using a coupler having height taps with a cable connected to each tap, a corresponding number of clamping members had to be installed at different locations on the strand for grounding each messenger wire. This of course is not only time consuming but also adds to the costs of installation.

Moreover, since most messenger wires are made of steel which is a rigid metal, pliers or other tools are needed in order to bend the connecting end of the wire and preform the same into a loop such that the wire can be securely connected to the strand clamping member by means of a screw extending through the looped connecting end of the wire. This further adds to the already numerous manipulative steps required for the whole installation.

SUMMARY OF THE INVENTION

It is therefore an object of the present invention to overcome the above drawbacks and to provide a hanger bracket which may serve not only for mounting a multi-tap directional coupler to a suspended wire, but also for grounding in common a plurality of messenger wires each of which supports a respective coaxial cable connected to the coupler.

It is another object of the invention to provide a hanger bracket with such common ground connections which enable the connecting end of a messanger wire to be formed into a loop and thus securely connected, without the use of pliers or other tools even in the case of messenger wires which are difficult to ply such as those made of steel.

According to a broad aspect of the invention, there is thus provided a bracket for hanging a multi-tap directional coupling device from a suspended wire and for grounding a plurality of support wires each of which extends along a respective cable, connected to the coupling device, for supporting same, the support wires each having a terminal end and a connecting portion contiguous thereto. The hanger bracket of the invention comprises an elongated member having a first end portion adapted to be detachably coupled to the coupling device, a second end portion provided with clamp means for releasable clamping engagement with the suspended wire, and a portion intermediate the first and second end portions defining a grounding plate. A separate fastener means is associated with each support wire for releasably securing the connecting portion thereof against the grounding plate whereby to provide a common ground for all the support wires.

In a preferred embodiment of the invention, the grounding plate is provided with a separate wire end retention means associated with each fastener means for retaining the terminal end of each support wire whereby to allow the connecting portion of each support wire to be bent about its associated fastener means and formed into an open loop defining a throat while the terminal end thereof is retained captive by the associated wire end retention means, prior to the connecting portion being secured by its associated fastener means.

Thus, by providing the hanger bracket with wire fastener means for securely connecting each support wire to the grounding plate of the bracket, the support wires need no longer be individually connected to the suspended wire since the bracket which is itself grounded to the suspended wire serves as a common ground connector for the wires. On the other hand, when use is made of wire end retention means, such means enables the terminal end of each support wire to be immobilized so as to allow the connecting portion thereof to be bent by hand about its associated fastener means and thus formed into a loop, thereby eliminating the need of pliers or the like.

Of course, the application of such wire end retention means is not limited to hanger brackets or other grounding brackets since it is apparent that the same can also be applied to any connector element for connecting an electrically conductive wire, including a live wire, for the purpose of facilitating its connection.

The present invention therefore provides, in another broad aspect thereof, a connector element for connecting an electrically conductive wire having a terminal end and a connecting portion contiguous thereto, which connector element comprises a plate member and fastener means for releasably securing the connecting portion of the wire against the plate member, the plate member being provided with wire end retention means for retaining the terminal end of the wire whereby to allow the connecting portion to be bent about the fastener means and formed into an open loop defining a throat while the terminal end is retained captive by the wire end retention means, prior to the connecting portion being secured by the fastener means. The connector element further includes guide means formed on the plate member and disposed adjacent the throat for arresting a segment of the looped connecting portion of the wire which extends closely opposite the wire end retention means.

Preferably, the releasable fastener means comprises a bolt having a head and a threaded stem in threadable engagement with a threaded bore in the plate member, and the wire end retention means is a hole formed in the plate member and located adjacent the threaded bore so as to enable the connecting portion of the wire to be wrapped around the stem with the loop being substantially entirely disposed underneath the head of the bolt. Thus, by simply inserting the terminal end of the wire into the wire end retention hole and then wrapping its connecting portion about the stem of the bolt which serves as a loop former, the connecting portion of the wire can be readily formed into a loop without the assistance of any tool. Moreover, the location of the wire end retention hole on the plate member is such that the looped connecting portion thus formed is substantially entirely disposed underneath the head of the bolt, thereby providing a secure connection.

The guide means which is provided on the plate member preferably comprises a guide abutment disposed in spaced relation to the threaded bore and the wire retention hole for maintaining the looped connecting portion of the wire positioned underneath the head of the bolt and preventing same from expanding laterally when the bolt is tightened and the head thereof frictionally engages the looped connecting portion to securely press same against the plate member.

BRIEF DESCRIPTION OF THE DRAWINGS

Further advantages and features of the invention will become apparent from the following detailed description of a preferred embodiment thereof as illustrated by way of example in the accompanying drawings, in which:

FIG. 1 is a perspective view of a strand hanger bracket according to a preferred embodiment of the invention, as seen installed on a strand;

FIG. 2 is a fragmentary side elevation view of the hanger bracket shown in FIG. 1; and FIGS. 3 and 3A are enlarged fragmentary views showing how a support wire is securely connected to the grounding plate of the bracket.

DESCRIPTION OF PREFERRED EMBODIMENTS

Referring to the drawings, then is illustrated a strand hanger bracket which is generally designated by reference numeral 10 and seen mounting a multi-tap directional coupler 12 to a strand 14 and grounding a plurality of steel messenger wires 16 (only one shown) each of which extends along a respective coaxial cable 18 for supporting same. The messenger wire 16 is hooked onto the strand 14 by means of a hooking member 20 clamped to the strand so as to hold the cable 18 connected to a tap of the coupler 12. The coupler 12, on the other hand, is connected by means of the feederline 22 via amplifiers (not shown) to the trunk cable 24 which runs parallel with the strand 14 and is held suspended therefrom by means of the lashing wire 26.

The bracket 10 comprises a U-shaped metal plate 28 having two opposed arms 30 and 32 and a base 34 interconnecting the arms. The arm 30 is detachably connected to the coupler 12 by means of the nut and bolt assembly 36, whereas the arm 32 is clamped to the strand 14. The base 34, on the other hand, defines a grounding plate adapted for connecting the messenger wires 16.

The arm 32 has an inwardly curved portion 38 adjacent its end edge and a separate plate 40 is juxtaposed over the curved portion 38 with an end edge thereof facing the end edge of the curved portion 38 and the opposite end edge abutting the outer face of the arm 32 against the abutment rib 42 provided thereon, whereby to act as a hinge allowing movement of the plate 40 towards or away from the curved portion 38. As best shown in FIG. 2, the plate 40 is outwardly curved between its end edges and defines together with the inwardly curved portion 38 clamp means with opposed jaws 44 and 46 at the facing end edges which cooperate to clamp the strand 14 therebetween. A releasable coupling means consisting of a nut and bolt assembly 40 is provided for moving the plate 40 towards the curved portion 38 of the arm 32 so as to secure the strand 14 between the jaws 44 and 46.

In order to prevent the bracket 10 from pivotally moving about the strand 14, the jaws are provided with wire gripping means which comprise two pairs of spaced-apart ribs 50 and 52 (only one rib of each pair being shown) disposed respectively within the jaws 44 and 46 and located adjacent the lateral edges of the curved portion 38 and plate 40. As shown, the ribs 50 of the jaw 44 face the ribs 52 of the other jaw 46 and bite into the strand 14 when the plate 40 is biased towards the curved portion 38 by means of the nut and bolt assembly 48.

The bracket 10 is further provided with guide means for preventing misalignment of the jaws 44 and 46 during opening and closing thereof. Such guide means include a projection 54 on the plate 40 and a corresponding opening 56 formed in the arm 32, into which the projection 54 is inserted. A similar guide projection 58 is also provided on the arm 32, which is spaced from the opening 56 and inserted into a corresponding opening 60 formed in the plate 40, such that corresponding guide projections and openings are inserted in one another.

In order to secure the messenger wires 16 to the grounding plate 34, there is a separate fastener means associated with each wire 16. In the embodiment illustrated, each fastener means comprises a bolt 62 having a head 64 and a threaded stem 66 in threadable engagement with a threaded bore 68 formed in the grounding plate 34. Associated with each bore 68 are also a wire end retention hole 70 as well as a wire guide abutment 72 in the form of a rib.

As shown in FIGS. 1 and 3, the messenger wire 16 is conveniently connected to the grounding plate 34 by first inserting the terminal end 74 thereof into the wire end retention hole 70 and then wrapping the connecting portion 76 of the wire contiguous to its terminal end 74 counterclockwise around the stem 66 of the bolt 62 so as to form the same into an open loop, while the terminal end 74 is retained captive in the hole 70. It should be noted that the wire end retention hole 70 is located adjacent the threaded bore 68 such that the looped connecting portion 76 thus formed is substantially entirely disposed underneath the head 64 of the bolt 62. The stem 66 thus serves as a loop former which enables the connecting portion 76 of the wire to be bent thereabout by means of only one hand grasping the wire 16. The bolt 62 is thereafter tightened so as to tightly press the looped connecting portion 76 against the grounding plate 34.

The wire guide abutment 72 which is disposed adjacent the throat of the open loop serves to maintain the looped connecting portion 76 of the wire positioned underneath the head 64 of the bolt 62 and thus to prevent the same from expanding laterally when the bolt 62 is tightened and the head 64 thereof frictionally engages the looped connecting portion 76 to securely press it against the grounding plate 34. It should be noted that the relative positions of the wire end retention hole 70 and wire guide abutment 72 could also be interchanged so as to enable the connecting portion 76 of the wire to be bent clockwise, instead of counterclockwise, around the bolt stem 66, as shown in FIG. 3A. An advantage of this arrangement over that shown in FIG. 3 is that any excess length of wire around the stem 66 will be guided into tight contact with the stem under the head 64 as the bolt 62 is tightened, thereby providing a tight grip of the connecting portion 76 of the wire around the stem 66. It should further be noted that the wire guide abutment 72, in either of the alternate positions shown in FIGS. 3 and 3A, prevents the wire from being dislodged from underneath the bolt head 64 during prolonged use and/or adverse weather conditions.

As best shown in FIGS. 3 and 3A, the wire guide abutment 72 is disposed in spaced relation to the threaded bore 68 and wire end retention hole 70 so as to arrest a segment of the looped connecting portion 76 which extends closely opposite the wire end retention hole 70. Such wire guide abutments 72 are particularly advantageous when using messenger wires 16 which are relatively thick (e.g. having a diameter between 0.05 and 0.08 inch) and/or made of rigid metal such as steel, but they may be dispensed with in the case of messenger wires which are of smaller size (e.g. having a diameter less than 0.05 inch) and/or made of a soft metal such as copper.

In the embodiment illustrated, there are eight fastener means 62,68 and associated wire end retention hole 70 and wire guide abutments 72, which are arranged in staggered relation on the base 34 of the U-shaped plate 28. It is apparent of course that a lesser number of such ground connections, for instance four, could also be provided on the planar portion of the arm 32 and arranged in facing pairs.

I claim:

1. A connector element for connecting an electrically conductive wire having a terminal end and a connecting portion contiguous thereto, said connector element comprising a plate member and fastener means for releasably securing said connecting portion of said wire against said plate member, said plate member being provided with wire end retention means for retaining said terminal end of said wire whereby to allow said connecting portion to be bent about said fastener means and formed into an open loop defining a throat while said terminal end is retained captive by said wire end retention means, prior to said connecting portion being secured by said fastener means, said connector element further including guide means formed on said plate member and disposed adjacent said throat for arresting a segment of the looped connecting portion of said wire which extends closely opposite said wire end retention means.

2. A connector element as claimed in claim 1, wherein said releasable fastener means comprises a bolt having a head and a threaded stem in threadable engagement with a threaded bore in said plate member, and wherein said wire end retention means is a hole formed in said plate member and located adjacent said threaded bore so as to enable said connecting portion of said wire to be wrapped around said stem with said loop being substantially entirely disposed underneath said head.

3. A connector element as claimed in claim 2, wherein said guide means comprises a guide abutment disposed in spaced relation to said threaded bore and said wire end retention hole for maintaining the looped connecting portion of said wire positioned underneath said head and preventing same from expanding laterally when said bolt is tightened and said head thereof frictionally engages said looped connecting portion to securely press same against said plate member.

4. A connector element as claimed in claim 3, wherein said wire end retention hole and said guide abutment are arranged relative to one another so as to permit said connecting portion of said wire to be bent clockwise around said stem, whereby any excess length of wire around said stem will be guided into tight contact with said stem under said head when said bolt is tightened, thereby providing a tight grip of said connecting portion of said wire around said stem.

5. A bracket for hanging a multi-tap directional coupling device from a suspended wire and for grounding a plurality of support wires each of which extends along a respective cable, connected to said coupling device, for supporting same, said support wires each having a terminal end and a connecting portion contiguous thereto, said bracket comprising:

an elongated member having a first end portion adapted to be detachably coupled to said coupling device, a second end portion provided with clamp means for releasable clamping engagement with said suspended wire, and a portion intermediate said first and second end portions defining a grounding plate; and a separate fastener mans associated with each said support wire for releasably securing the connecting portion thereof against said grounding plate whereby to provide a common ground for all said support wires.

6. A hanger bracket as claimed in claim 5, wherein said grounding plate is provided with a separate wire end retention means associated with each said fastener means for retaining the terminal end of each said support wire whereby to allow the connecting portion of each said support wire to be bent about its associated fastener means and formed into an open loop defining a throat while the terminal end thereof is retained captive by the associated wire end retention means, prior to the connecting portion being secured by its associated fastener means.

7. A hanger bracket as claimed in claim 6, wherein said elongated member is a U-shaped plate having opposed first and second arms and a base interconnecting said arms, said second arm having an end edge and an inwardly curved portion contiguous thereto, and wherein a separate plate is juxtaposed over said inwardly curved portion with an end edge thereof facing the end edge of said inwardly curved portion and an opposite end edge abutting an outer face of said second arm, said separate plate being outwardly curved between the end edges thereof and defining together with said inwardly curved portion said clamp means with opposed jaws at the facing edges cooperating to clamp said suspended wire therebetween, said hanger bracket further including releasable coupling means operable to move said separate plate towards said inwardly curved portion of said second arm to secure said suspended wire between said jaws.

8. A hanger bracket as claimed in claim 7, wherein said jaws are provided with wire gripping means for preventing said bracket from pivotally moving about said suspended wire.

9. A hanger bracket as claimed in claim 8, wherein said wire gripping means comprise a pair of spaced-apart ribs within each jaw, the ribs of one jaw facing those of the other jaw.

10. A hanger bracket as claimed in claim 7, further including guide means for preventing misalignment of said jaws during opening or closing thereof.

11. A hanger bracket as claimed in claim 10, wherein said guide means comprise a projection on said separate plate at said opposite end edge and an opening formed therein at said opposite end edge and spaced from said projection, said second arm being provided with corresponding spaced-apart opening and projection, corresponding projections and openings being inserted into one another.

12. A hanger bracket as claimed in claim 7, wherein there are four said fastener means and associated wire end retention means, said fastener means and associated wire end retention means being provided on said second arm and arranged in facing pairs.

13. A hanger bracket as claimed in claim 7, wherein there are eight said fastener means and associated wire end retention means, said fastener means and associated wire end retention means being provided on said base and arranged in staggered relation.

14. A hanger bracket as claimed in claim 6, wherein said grounding plate is provided with a separate guide means associated with each said fastener means and disposed adjacent the throat of the looped connecting portion of each said support wire so as to arrest a segment of said looped connecting portion which extends closely opposite the associated wire end retention means.

15. A hanger bracket as claimed in claim 14, wherein each said releasable fastener means comprises a bolt having a head and a threaded stem in threadable engagement with a threaded bore in said grounding plate, and wherein each said wire end retention means is a hole formed in said grounding plate and located adjacent its associated threaded bore so as to enable the connecting portion of each said support wire to be wrapped around the stem of its associated bolt and thereby formed into an open loop which is substantially entirely disposed underneath the head of said associated bolt.

16. A hanger bracket as claimed in claim 4, wherein each said guide means comprises a guide abutment disposed in spaced relation to its associated threaded bore and the wire end retention hole associated therewith for maintaining the looped connecting portion of each said support wire positioned underneath the head of its associated bolt and preventing same from expanding laterally when said associated bolt is tightened and said head thereof frictionally engages said looped connecting portion to securely press same against said grounding plate.

* * * * *